US005388541A

United States Patent [19]

Dumas et al.

[11] Patent Number: 5,388,541

[45] Date of Patent: Feb. 14, 1995

[54] TANKER SHIP DESIGN FOR REDUCING CARGO SPILLAGE

[76] Inventors: Allen E. Dumas; Mark C. Dumas; Stephen A. Dumas, all of Oakhill Rd., Keller, Tex. 76248

[21] Appl. No.: 945,138

[22] Filed: Sep. 15, 1992

[51] Int. Cl.[6] ..... B63B 39/00

[52] U.S. Cl. ..... 114/74 R; 114/74 A

[58] Field of Search ..... 114/65 R, 74 R, 74 A, 114/72

[56] References Cited

U.S. PATENT DOCUMENTS

| | | | |
|---|---|---|---|
| 3,859,944 | 1/1975 | Warner | 114/74 R |
| 4,241,683 | 12/1980 | Conway | 114/74 R |
| 4,960,347 | 10/1990 | Strange | 114/74 R |
| 5,101,750 | 4/1992 | Dumas | 114/74 |
| 5,125,439 | 6/1992 | Perkins | 114/74 R |
| 5,158,031 | 10/1992 | Arnett et al. | 114/74 R |

FOREIGN PATENT DOCUMENTS

| | | | |
|---|---|---|---|
| 2118091 | 11/1971 | Germany | 114/74 R |
| 106351 | 5/1917 | United Kingdom | 114/74 R |

*Primary Examiner*—Stephen P. Avila
*Attorney, Agent, or Firm*—Geoffrey A. Mantooth

[57] ABSTRACT

A tanker ship has upper and lower tanks for carrying cargo. The upper and lower tanks are separated from each other by an intermediate deck. The lower tank is filled with cargo to the intermediate deck such that the cargo is slightly pressurized and there is no ullage space. As the tanker sails, the cargo in the lower tank is likely to change pressure due to temperature changes. These pressure changes are detected by a pipe extending from the lower tank through the intermediate deck up to an ullage space in the corresponding upper tank. A siphon is used to transfer cargo between the upper and lower tanks to equalize the pressures. In the event that the lower tank is breached, sensors are used to detect the resulting drop in pressure from the lower tank cargo. The sensor system provides a warning to the crew, closes the siphon to prevent cargo transfer from the upper tank to the lower tank and opens an auxiliary pipe located in the upper portion of the lower tank. The auxiliary pipe is used to discharge cargo from the breached lower tank.

14 Claims, 4 Drawing Sheets

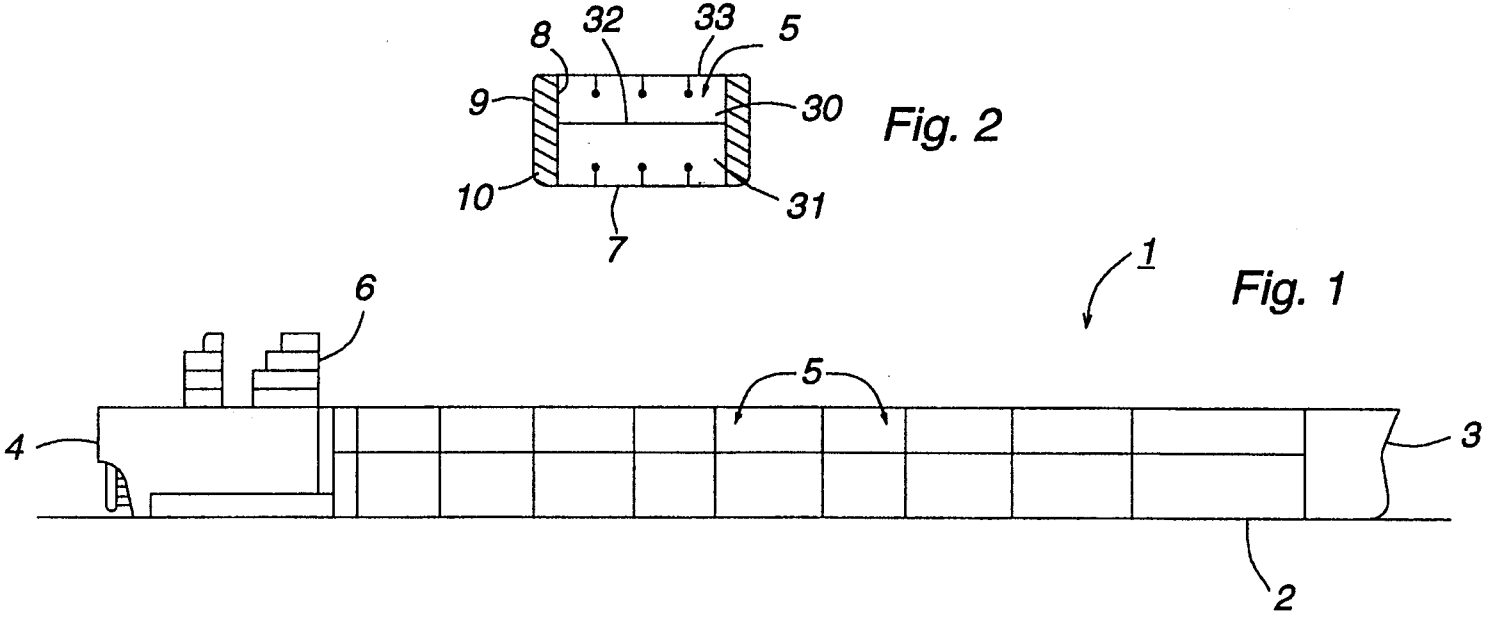
Fig. 1
Fig. 2
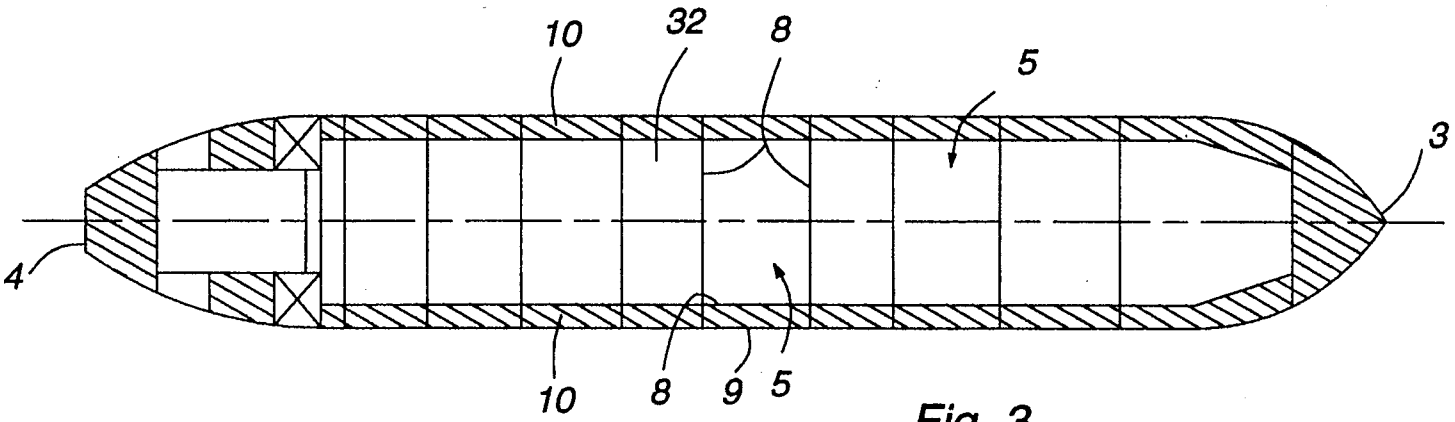
Fig. 3

TANKER SHIP DESIGN FOR REDUCING CARGO SPILLAGE

FIELD OF THE INVENTION

The present invention relates to those types of ships referred to as tankers that carry liquid cargo such as petroleum oil and the like, and in particular to tankers equipped with an intermediate oil-tight deck.

BACKGROUND OF THE INVENTION

Much of this country's energy needs are met with oil, both domestically produced and imported from foreign countries. Furthermore, oil is used as a raw material in many manufactured goods and materials, such as plastics.

Much of this oil is transported from place to place in tankers. Tankers are used to ship oil from Alaska to the continental United States. Tankers are also used, among other things, to ship oil between the gulf, west and east coasts. In addition, the tankers are used to import oil from foreign countries.

Oil spills from tankers in and near ports have happened in the past and will likely continue in the future. Unlike tankers operating on the high seas, where they are subjected mainly to wind and wave forces, tankers operating in and around ports are subjected to high density shipping traffic, limited maneuvering room and natural hazards such are reefs, shifting bottoms, etc.

Oil spills near coast lines have grave environmental consequences, resulting in large scale wildlife kills, fouled beaches, estuaries and water bottoms. Oil spills also have grave economic consequences as evidenced by Exxon spending over one billion dollars to clean up after the Exxon Valdez ran aground in Alaska.

It is plainly clear that the technology needed to effectively clean up an oil spill is sorely lacking. Containment booms and skimmers, even if employed timely, are unable to contain a major skill. Surfactants merely make the problem disappear from view by causing the oil to sink to the bottom, where it interferes with bottom life. Microbes have recently proven satisfactory in cleaning up spills, but only on small portions of spills.

The most effective solution is to limit the amount of oil that is spilled into the water once a tanker's cargo tanks have been ruptured. Double hull construction is one way to limit oil spills. In tankers equipped with a double hull, the bottom and the sides of the tanker have two walls between the sea and the cargo. Although this construction makes it more difficult to breach the cargo tanks, a breach is still possible.

U.S. Pat. No. 5,101,750 discloses horizontal walls or decks located intermediate of the top and bottom walls of a tank. Such a configuration has been referred to as an intermediate oil-tight deck. One of the co-inventors herein is the inventor of U.S. Pat. No. 5,101,750.

The intermediate oil-tight deck, when used in conjunction with double sides, have emerged as one of the more promising alternative tanker designs and is considered by many as being superior to the double hull tanker design in most accidents scenarios. The intermediate oil-tight deck and the double sides offer several advantages over the double hull. The National Research Council in their recent study entitled *TANKER SPILLS PREVENTION BY DESIGN* stated that "The intermediate oil-tight deck with double sides is unique in that the pressure of sea water forced into the vessel (rather than oil flowing out) in the event of tank rupture would be significantly greater than the pressures available in all other design alternatives." This is because, as discussed in U.S. Pat. No. 5,101,750, the intermediate deck removes the head pressure found in tanks that extend from the hull bottom above the water line to the top deck.

Several problems associated with the intermediate oil-tight deck with double sides have been identified and can be corrected by the installation of the invention described herein. When a void is allowed to exist below the intermediate deck, several problems arise. Explosive gasses can collect in the ullage space beneath the intermediate deck in the lower tanks, thereby creating hazardous conditions for the crew. Sloshing of the cargo will occur in both the upper and lower tanks, causing bulkhead damage below the intermediate deck and the weather decks. Slamming (vertical movement of the cargo) can cause damage to the intermediate deck as well as to the hull bottom. Also, the fact that an ullage space is present in the lower tank produces large critical fatigue stresses on the intermediate deck, whenever there is cargo in the upper tank. Furthermore, the ullage space reduces the cargo carrying capacity of the lower tanks. The charging operation of the lower cargo tanks is made more complex and is slowed considerably when a void below the intermediate deck is required.

SUMMARY OF THE INVENTION

It is an object of the present invention to improve upon the performance of the intermediate oil-tight deck design, thereby reducing the amount of oil spilled from a breached cargo tank in an oil tanker.

The tanker ship of the present invention includes plural lower tanks, with each of the lower tanks being located between a bottom wall and a respective intermediate wall. There are plural upper tanks, with each of the upper tanks being located between a respective one of the intermediate walls and a top wall. Each of the intermediate walls is oil-tight so as to separate the respective lower tank from the respective upper tank. The ship has means for sensing a pressure differential between cargo located in the upper tank and cargo located in the lower tank. A means for transferring cargo between the upper and lower tanks operates in response to a pressure differential as detected by the means for sensing a pressure differential, so as to equalize the pressure between the upper tank cargo and the lower tank cargo. With the present invention, the lower tank located beneath the intermediate wall can be filled completely, eliminating any ullage space. Because the lower tank has no ullage space, the cargo does not slam or slosh. Also, the lower tank has a larger capacity.

In accordance with one aspect of the present invention, the means for sensing a pressure differential includes a passageway through the intermediate wall. The passageway has upper and lower ends, with the lower end being open to the lower tank and the upper end being located in an ullage space of the upper tank. In another aspect of the present invention, the means for transferring cargo between the upper and lower tanks includes a siphon having first and second ends. The siphon first end is located in the upper tank below the ullage space and the siphon second end is located in the lower tank.

There is also provided a means for indicating to personnel on the tank that the lower tank has been breached. The indicating means is responsive to a means for detecting a pressure drop in the lower tank cargo. The pressure drop in the lower tank cargo is caused by a breach in the lower tank.

There is also provided a secondary pipe located in the lower tank. The secondary pipe is in addition to a main pipe for charging and discharging cargo into the lower tank. The secondary pipe has a second opening located in an upper portion of the lower tank, wherein the secondary pipe allows for the discharge of cargo from the lower tank in the event of a breach of the lower tank.

BRIEF DESCRIPTION OF THE DRAWINGS

FIG. 1 is a schematic longitudinal cross-sectional side view of a tanker equipped with intermediate oil-tight decks.

FIG. 2 is a schematic transverse sectional view of the tanker of FIG. 1.

FIG. 3 is a schematic longitudinal cross-sectional plan view of an intermediate oil-tight deck with double sides.

DESCRIPTION OF PREFERRED EMBODIMENT

Figure 4:
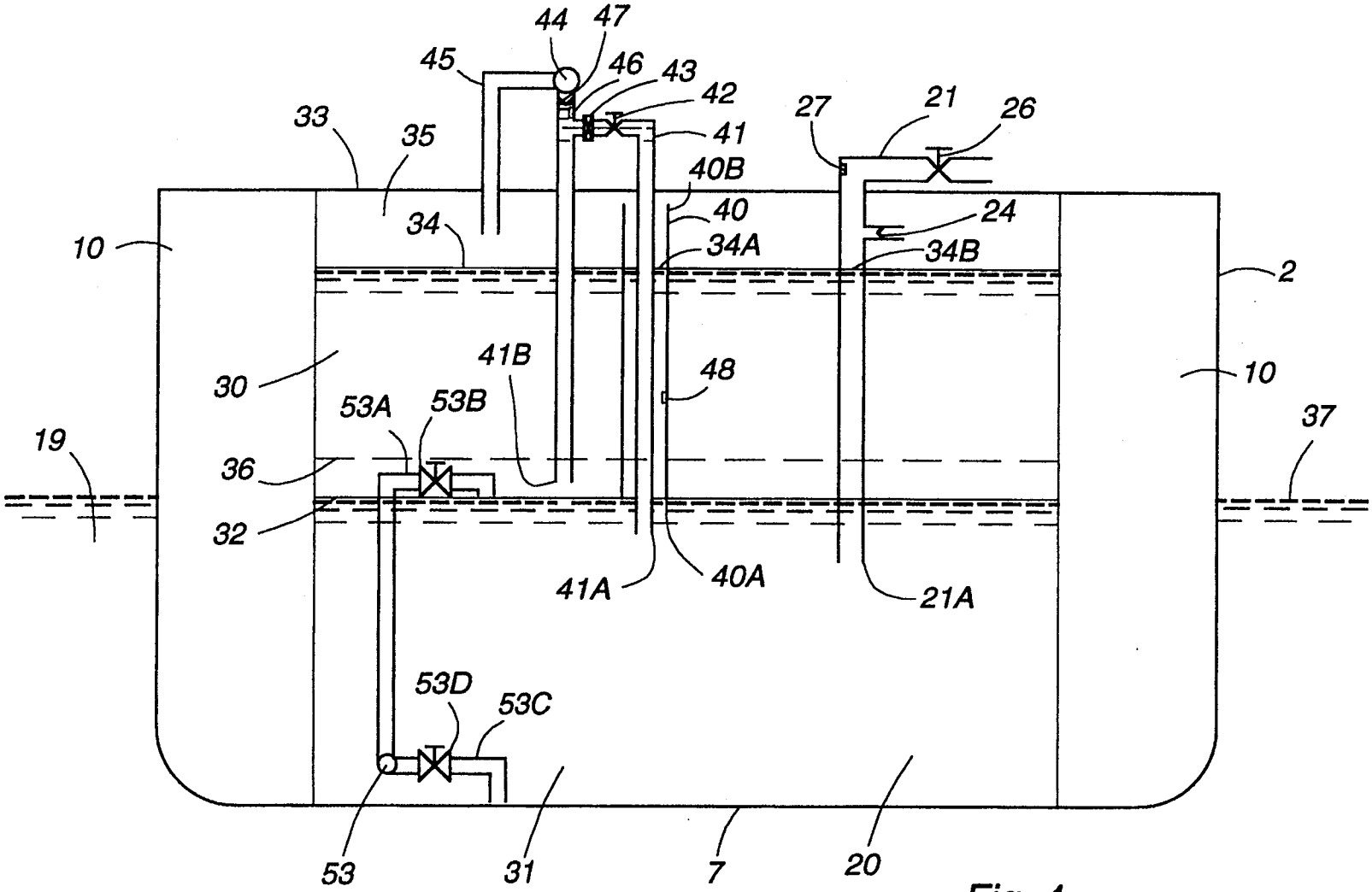
FIG. 4 is a schematic transverse cross-sectional side view of an intermediate oil-tight deck with double sides of the present invention, in accordance with a preferred embodiment.

In FIG. 1, there is shown a tanker 1. The tanker 1 has a hull 2 with a bow 3 and a stern 4, a bottom and sides. The tanker 1 has multiple tanks 5 for carrying liquid cargo such as crude oil and oil products. In addition, the tanker has plural ballast tanks, including fore and aft tanks. The aft portion of the tanker has the engine room, crew quarters and the bridge 6. The number and size of cargo tanks 5 depends on the type of tanker. The tanks are typically arranged in ordered longitudinal fashion. My previous patent, U.S. Pat. No. 5,101,750, describes tankers. The disclosure of U.S. Pat. No. 5,101,750 is incorporated herein by reference.

Referring to FIGS. 2 and 3, each tank 5 is generally rectangular, having a top wall 33 (the top or weather deck of the tanker), a bottom wall 7 (the bottom of the hull), and four side walls 8. The side walls 8 are typically vertical bulkheads that are common to the respective adjacent tanks. The side wall bulkheads 8 are water tight (or oil tight) and serve to separate the separate tanks from each other. The tanker 1 is a double sided tanker and thus has double walls 8, 9 along the outside of the cargo tanks 5. The double walls 8, 9 form side tanks 10. The top deck 33 of the tanker, which serves as the top wall of the cargo tanks 5, is typically slanted, being high along the center line and tapering downwardly to the sides of the tanker. This configuration enables the deck to shed water more easily.

Referring now to FIG. 4, each tank 5 is divided into an upper tank 30 and a lower tank 31 by an intermediate deck 32. The deck 32, which is located at or near the water level 37 of the hull, is oil tight. The upper tank 30 is located between the intermediate deck 32 and the deck 33, while the lower tank 31 is located between the decks 32 and the bottom 7. The two tanks 30, 31 are isolated from each by the rigid deck 32, so that if a puncture occurs in the bottom wall 7 of the lower tank, the oil (or other cargo) in the lower tank 31 is not subjected to any head pressure by the oil (or other cargo) in the upper tank 30.

The deck 32 is coupled to all of the side walls 8 in the tank 5 so as to be oil tight and to prevent leakage in the upper tank 30 to the lower tank 31. The deck 32 is generally horizontal, having a slight slope to allow for drainage during tank washup and to allow venting of gasses in the lower tank 31 during loading of cargo. The deck 32 is located at or below the water line 37 of the tanker when the tanker is loaded.

The present invention includes a cargo equalizer unit which allows the lower tank 31 to be completely filled with cargo, thereby eliminating ullage space in the lower tank. The cargo equalization unit allows for expansion and contraction of the cargo during tanker transit. The cargo equalizer unit includes an open passageway 40 through the intermediate deck 32 and a siphon 41 connecting the cargo in the upper and lower tanks 30, 31. The passageway 40 is a pipe that is several inches in diameter (in the drawings, the size of the pipes 40, 41 and side tanks 10 have been exaggerated for clarity) and having a lower end 40A and an upper end 40B. The lower end 40A is flush with the bottom surface of the intermediate deck 32 and is located at the highest point of the intermediate deck. The lower end 40A is open to the lower tank 31, while the upper end 40B is open to the upper tank 30. The upper end 40B is located in the ullage space 35 of the upper tank 30 so as to be above the estimated top level 34 of the cargo. This prevents the cargo in the upper zone from flowing to the lower zone through the pipe 40.

The siphon is formed by a pipe 41 that has a lower end 41A and an upper end 41B. The lower end 41A is open to the lower tank 31, while the upper end 41B is open to the upper tank 30. The lower end 41A of pipe 41 protrudes into the lower tank 31 several inches below the intermediate deck to ensure that most gasses generated in the lower tank flow into the ullage space 35 through pipe 40 and not through pipe 41. Pipe 41 rises upward through pipe 40, through the upper deck 33 and returns to the upper tank 30 with its lower end 41B located near the intermediate deck 32 and preferably below a hydrostatic level 36 (the hydrostatic level 36 will be explained in more detail below). The siphon pipe 41 is approximately two inches in diameter.

To load and unload cargo into the upper and lower tanks, each upper and lower tank is loaded or charged and discharged separately with the lower tank being charged first. Piping and valves branch off the crude oil main line 53 for this purpose. There is an upper tank pipe 53A, an upper tank valve 53B, a lower tank pipe 53C and a lower tank valve 53D. The valves 53B, 53D are controlled from the top deck 33 or from a pump room. The upper tank and lower tank pipes 53A, 53C are connected to the main line 53. The openings of the pipes 53A, 53C are located near the bottoms of the respective tanks. The lower tank 31 is charged first, through pipe 53C. When the lower tank 31 is filled, the crew can then open valve 53B and close valve 53D. This routes the cargo into the upper tank 30 through pipe 53A. Sensor 48 located inside passageway 40 detects the presence of cargo standing inside the passageway 40 and alerts crew personnel and a computer 61 (see FIG. 5) when the lower tank is completely filled. Sensor 48 is a liquid level sensor such as a float device. It can sense the presence or absence of liquid inside of passageway 40. The passageway 40 allows any overflow during the charging of the lower tank to flow into the upper tank. Thus, the charging pumps can operate at maximum capacity while the flow of cargo is rerouted from the upper tank to the lower tank. The upper tank is filled to the desired level in accordance with conventional practice. An ullage space 35 is maintained in the upper tank. This space 35 is typically filled with inert gas to minimize the danger of explosion. The lower tank 31 has no ullage space, all of the gasses having been driven up into the upper tank through pipe 40.

Discharging of cargo is the reverse process of charging. The upper tank is discharged first, followed by the lower tank.

An alternative method of charging the upper and lower tanks with cargo is to install a sluice valve in the intermediate deck 32. This valve is opened during the charging and discharging operation and closed at all other times.

In order for pipe 41 to function effectively as a siphoning device, it should first be purged of all gasses captured inside of the pipe during the charging process of the lower tank. Purging is accomplished during or after loading by action of a purge pump 44 which can be either hand operated or motor driven. The pump 44 is located above siphon 41 so as to receive all gasses in the siphon pipe. The pipe 41 is equipped with a valve 42, which is opened after the upper tank has been filled to the desired level. With the valve 42 opened and the pump 44 operating, pipe 45 vents any gasses and cargo removed from pipe 41 into the ullage space 35 to be neutralized by the inert gas system. Fluid level sensor 46 detects the presence of oil in the pipe just below the pump 44 and provides an electronic signal to alert crew personal and the computer 61 to cease purging operations. A one way valve 47 allows gasses to be removed from pipe 41 and prevents the flow of gas from entering pipe 41 from above. Flow meter 43 detects the flow of oil through pipe 41. The output signal from the flow meter 43 is used to inform crew personnel of the quantity and direction of oil flow.

During transit of the tanker, the volume of cargo in the tanks will either expand or contract, depending upon the temperature change of the cargo. If the cargo in the upper tank expands or contracts, the ullage space 35 is able to absorb the change in volume in the cargo. However, because the cargo in the lower tank is contained by the walls of the lower tank, expansion and contraction of the cargo is accounted for by the cargo equalization unit 40, 41. When the oil cargo in the lower tank expands with increasing temperature, the oil level 34A inside pipe 40 rises to a level higher than the oil level 34 in the upper tank 30. The two unequal levels 34A, 34 are symptoms of a pressure imbalance between the tanks 30, 31. The pressure imbalance causes oil to be siphoned from the lower tank 31 to the upper tank 30 through pipe 41. The valve 42 is left in the open position. The siphoning action continues until the oil level 34 in the upper tank 30 is equal to the oil level 34A in pipe 40.

The volume of cargo will decrease with a decrease in temperature and reverse the above process. When the volume decreases, the level of the oil standing inside pipe 40 will lower causing a transfer of cargo from the upper tank to flow through pipe 41 to the lower tank. This transfer in pipe 41 continues until the level of cargo 34A inside pipe 40 equals the level of cargo 34 inside the upper tank. The forces due to pressure above and below the intermediate deck remain constant and equal as a result of the above described siphoning action. Such equalization of pressures on the intermediate deck reduces the critical fatigue stresses on the deck.

Figure 4A:
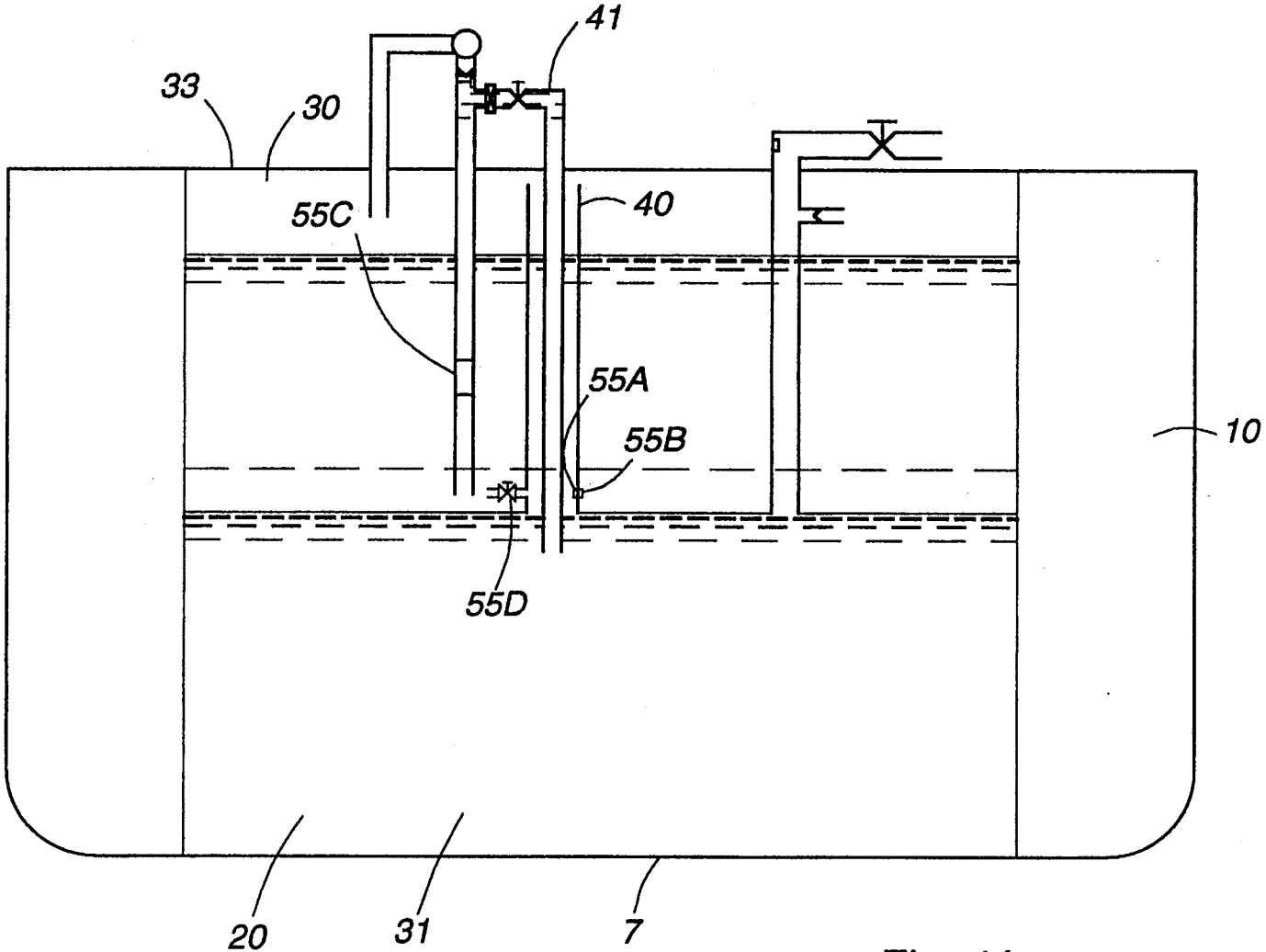
FIG. 4A is like FIG. 4, but shows an alternative embodiment of the present invention.

The passageway 40 and siphon 41 system requires no moving parts to equalize pressures in the cargo tanks. It is automatic in operation, moving cargo between the upper and lower tanks to equalize the pressure. The siphon 41 is independent of the volume of cargo in the upper tank. An alternative embodiment uses pressure sensors 55A, 55B (see FIG. 4A). There is a sensor 55A located inside passageway 40 and another sensor 55B located outside passageway 40. Both sensors are located near the intermediate deck 32. A pump 55C is provided in pipe 41. The pump 55C is connected to the sensors 55A, 55B by wires (not shown). When the pressure sensors sense a pressure differential between the cargo and the upper and lower tanks, the pump is activated to transfer cargo from the higher pressure tank to the lower pressure tank to equalize pressures. Also, the passageway 40 can be provided with a shunt valve 55D located near the intermediate deck. The valve, which is controlled from the top deck, could be opened to allow equalization of pressures between the upper and lower tanks. The shunt valve would be used as an alternative or as a backup to the siphon.

Figure 5:
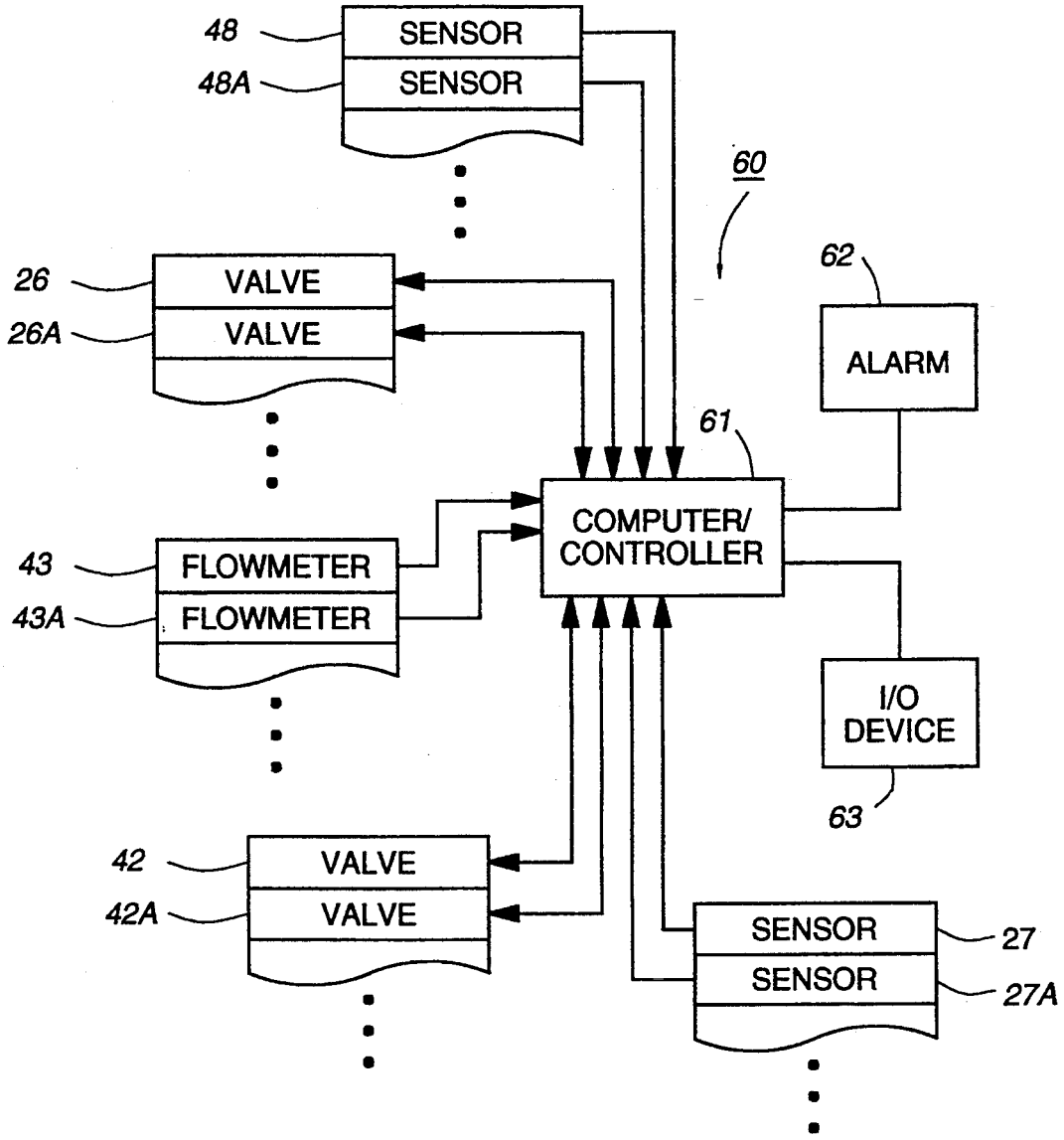
FIG. 5 is a block diagram showing the electrical control system of the present invention.

In FIG. 5, there is shown a block diagram of the control system 60. The control system 60 includes a computer controller 61, an alarm 62 and an input/output device 63. Connected to the inputs of the computer 61 are plural passageway sensors 48, 48A, etc. there being one sensor for each set of upper and lower tanks 30, 31. The sensors 48, 48A are fluid level sensors. Also connected to the inputs of the computer 61 are plural flow meters 43, 43A, etc., there being one flow meter 43 for each siphon pipe 41. Each set of upper and lower tanks has a siphon pipe 41 and a pipe 40. The alarm 62 is connected to an output of the computer. The alarm 62 includes audio annunciators located on the bridge 6 and throughout the ship. The input/output device 63 includes a monitor and keyboard located on the bridge, which monitor provides identifying information to personnel.

Valves 42 are solenoid operated and controlled by the control system 60 when the hull is breached. These valves are also designed to be operated locally with a hand wheel or remotely by crew personnel. Valves 42 can be automatically or manually closed when a breached hull is detected to prevent the flow of cargo from the upper tank 30 to the lower tank 31 through respective siphon 41. With valve 42 closed, the output signal from the flow meter 43 ceases, indicating that the emergency action taken has been completed.

Pipe 21 provides access to the lower tank from above the weather deck 33 for the emergency removal of oil in the event of a breached hull. Pipe 21 extends through the weather deck 33 and through intermediate deck 32, where it terminates in the upper region of the lower tank. The lower end 21A of the pipe is located several inches below the intermediate deck to avoid collecting gasses generated in the lower tank. The lower end of pipe 21 is open to the lower tank. Valve 26 is located on the deck 33 and is normally closed to reduce human error and is opened only in an emergency. Valve 24 is a one way check valve that allows gasses captured inside pipe 21 to exit pipe 21 during the charging process of the lower tank. Valve 24 is designed to allow cargo to rise inside pipe 21 by removing the gas inside pipe 21 when its pressure exceeds the pressure in the ullage space 35 of the upper tank. Valve 24 also prevents any gas in the ullage space 35 from entering the pipe 21 to effectively seal the gas inside the pipe 21.

The sides 8 of the upper and lower tanks 30, 31 are protected by the outer side walls 9 of the hull. Thus, the side tanks 10 protect the sides 8 of the upper and lower tanks. The intermediate deck 32 and the present invention protect the cargo from spillage if the bottom wall 7 of a lower tank is breached. In the event of a breach in the lower tank 31 due to a breached lower wall 7, the oil standing inside passageway 40 rapidly drops to the hydrostatic level 36. This is because the oil in the lower tank 31 is slightly pressurized by the head pressure provided by the small volume of oil in the passageway 40. When the lower tank is ruptured, the pressure in the lower tank cargo equals the pressure of the water 19 outside the hull. Sensor 48, which is located above this hydrostatic level, detects the absence of oil in passageway 40 and generates an electronic signal. The signal is received by the computer 61, which identifies the particular lower tank which has been breached. The computer 61 activates the alarm 62 to notify the crew of the fact that the hull has been breached and displays the information of the tank location on the input/output device 63.

Sensors 43 and 27 provide redundant information to the computer 61 on the breach of the lower tank. A breach in the lower tank causes the level 34A in the pipe 40 to fall. This would cause a siphoning of an above normal quantity of oil from the upper tank to the lower tank. Flow meter 43 detects the movement of this larger quantity of oil in the siphon pipe 41 and signals the computer 61. In addition, there may be a transient or abrupt change in the flow of oil through pipe 41. The computer 61 interprets these events as a breached lower tank and activates the alarm 62 and provides information identifying the breached tank on the input/output device 63. The computer 61 also closes the valve 42 to prevent further siphoning of cargo 20 into the lower tank.

Pressure sensor 27 is also activated by a breach in the lower tank. Under normal conditions, the level 34B of oil in pipe 21 is relatively constant. During loading of the lower tank, the pipe 21 receives oil from the lower tank through its lower end 21A. Air is pushed out of the upper end of the pipe through the one way check valve 24. The valve 26 is normally closed. When the lower tank is breached, the level of oil in pipe 21 drops, thereby decreasing the pressure in the sealed upper portion of the pipe 21. This lower pressure is detected by pressure sensor 27, located inside pipe 21 above the top deck 33. Sensor 27 sends a signal to the computer 61, which, upon receiving a signal from any sensor 27, 48, 43 in the tank, opens valve 26 to allowing discharging of the cargo from the lower tank. This is in addition to closing valve 42.

Oil can and should be removed from the breached lower tank as quickly as possible in order to prevent the unnecessary loss of oil as a result of wave motion or tanker motion. Oil can be removed through both pipe 53C and pipe 21. However, as oil is removed from the lower tank, water 19 will move into the tank through the breach, eventually encompassing the inlet to pipe 53C. Thus, oil must be removed through pipe 21, which has its inlet closer to the intermediate deck 32. The rapid removal of oil from the lower tank through pipe 21 further increases the flow of sea water into the lower tank through the breach, which in turn reduces the amount of oil flowing out through the breach.

The present invention allows the lower tank to be filled with cargo so as to eliminate the ullage apace in the lower tank. The lack of ullage space in the lower tank has several advantages over the prior art lower tanks designed with ullage spaces. First, there is no space in the lower tank for explosive gasses to accumulate. Also, the cargo in the lower tank contacts the intermediate deck 32. Therefore, the cargo in the lower tank is confined and will not slosh (horizontal movement) or slam (vertical movement). Such movement is conductive to structural failure. Furthermore, the intermediate deck 32 does not bear the full weight of the cargo in the upper tank, because the intermediate deck is supported by the cargo in the lower tank. Thus, the mechanical integrity of the intermediate deck is maintained.

Economic efficiencies are introduced by the present invention. Because there is no ullage space in the lower tank, each lower tank on the ship can carry more cargo. Port time is reduced during loading operations because the pumps can be run at a maximum capacity during the switch over from the lower tank to the upper tank. Any overflow of the lower tank is routed into the upper tank by the pipe 40. In addition, some overflow will escape pipe 21 through valve 24.

Each set of upper and lower tanks is provided with a passageway 40, a siphon 41, pipes and valves 53A–53D, pipe 21 and the sensors 27, 48, 46, 43.

The foregoing disclosure and the showings made in the drawings are merely illustrative of the principles of the invention and are not to be interpreted in a limiting sense.

We claim:

1. A tanker ship comprising:

a) a lower tank, said lower tank being located between a bottom wall and an intermediate wall;

b) an upper tank, said upper tank being located between said intermediate wall and a top wall, said intermediate wall being oil tight so as to separate said lower tank from said upper tank;

c) means for transferring cargo between said upper and lower tanks in response to a pressure differential in said upper and lower tanks, so as to equalize the pressure between said upper tank cargo and said lower tank cargo on said intermediate wall, said meads for transferring cargo being independent of the volume of cargo in said upper tank;

d) said means for transferring cargo comprising a siphon having first and second ends, said first end being located in said upper tank below an ullage space, said second end being located in said lower tank.

2. The tanker ship of claim 1 further comprising a passageway through said intermediate wall, said passageway having upper and lower ends, said lower end being open to said lower tank, said upper end being located in an ullage space of said upper tank.

3. The tanker ship of claim 1 further comprising means for purging said siphon of gas and filling said siphon with said cargo.

4. The tanker ship of claim 1, further comprising:

a) a main pipe located in said lower tank, said main pipe having a first opening located near said bottom wall in said lower tank so as to allow the charging and discharging of cargo into said lower tank;

b) a secondary pipe in said lower tank having a second opening located in an upper portion of said lower tank so as to be near said intermediate wall, said secondary pipe for allowing the discharge of cargo from said lower tank in the event of a breach of said lower tank.

5. The tanker ship of claim 1, wherein said upper and lower tanks have double sides and said intermediate wall is located near a water line of said ship.

6. The tanker ship of claim 1, further comprising:

a) means for purging said siphon of gas and filling said siphon with said cargo;

b) a main pipe located in said lower tank, said main pipe having a first opening located near said bottom wall in said lower tank so as to allow the charging and discharging of cargo into said lower tank and a secondary pipe in said lower tank having a second opening located in an upper portion of said lower tank so as to be near said intermediate wall, said secondary pipe for allowing the discharge of cargo from said lower tank in the event of a breach of said lower tank;

c) said upper and lower tanks have double sides and said intermediate wall is located near a water line of said ship.

7. The tanker ship of claim 1 further comprising a valve located in said means for transferring cargo.

8. The tanker ship of claim 1, wherein said lower tank is completely filled with cargo so as to eliminate ullage space in said lower tank and so as to slightly pressurize said lower tank cargo, further comprising;

a) means for detecting a drop in pressure of said lower tank cargo, said drop in pressure being caused by a breach of said lower tank;

b) means for closing said siphon in response to a drop in pressure as detected by said means for detecting a drop in pressure.

9. The tanker ship of claim 8 further comprising means for alarming a crew of said tanker ship, said means for alarming being responsive to a drop in pressure as detected by said means for detecting a drop in pressure.

10. The tanker ship of claim 4, wherein said lower tank is completely filled with cargo so as to eliminate ullage space in said lower tank and so as to slightly pressurize said lower tank cargo, further comprising;

a) means for detecting a drop in pressure of said lower tank cargo, said drop in pressure being caused by a breach of said lower tank;

b) valve means for opening and closing said secondary pipe, said valve means being responsive to said means for detecting a drop in pressure when a pressure drop in said lower tank is detected such that said valve means opens.

11. The tanker ship of claim 10 further comprising means for alarming a crew of said tanker ship, said means for alarming being responsive to a drop in pressure as detected by said means for detecting a drop in pressure.

12. A method of shipping liquid cargo in a tanker ship, comprising the steps of:

a) filling a lower tank with said cargo up to a top wall of said lower tank;

b) filling an upper tank with said cargo and leaving an ullage space in said upper tank, said ullage space creating a top level of said cargo in said upper tank;

c) if a pressure differential exists between said cargo in said upper tank and said cargo in said lower tank then siphoning cargo from said tank with a higher pressure to a location above said top level of cargo in said upper tank and then to said tank with a lower pressure so as to equalize the cargo pressures in said upper tank and said lower tank.

13. A tanker ship, comprising:

a) a lower tank, said lower tank being located between a bottom wall and an intermediate wall;

b) an upper tank, said upper tank being located between said intermediate wall and a top wall, said intermediate wall being oil tight so as to separate said lower tank from said upper tank;

c) a first passageway having first and second ends and an intermediate portion located between said first and second ends, said first end being located in said upper tank below an ullage space, said second end being located in said lower tank, and said intermediate portion being located above a top cargo level in said upper tank;

d) a second passageway through said intermediate wall, said second passageway having upper and lower ends, said lower end being open to said lower tank, said upper end being located in an ullage space of said upper tank.

14. The tanker ship of claim 13 further comprising:

a) a flow monitor in said first passageway;

b) a valve in said first passageway; and c) means for closing said valve, said means for closing said valve having an output connected to said valve and an input connected to said flow monitor, wherein said means for closing said valve closes said valve when said flow monitor detects a breach of said lower tank.

* * * * *